US007062186B2

(12) United States Patent
Kyung

(10) Patent No.: US 7,062,186 B2
(45) Date of Patent: Jun. 13, 2006

(54) METHOD OF MEASURING RESISTANCE OF A TRANSFER ROLLER

(75) Inventor: Myung-ho Kyung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 75 days.

(21) Appl. No.: 10/822,810

(22) Filed: Apr. 13, 2004

(65) Prior Publication Data

US 2005/0095025 A1 May 5, 2005

(30) Foreign Application Priority Data

Oct. 30, 2003 (KR) ..... 10-2003-0076277

(51) Int. Cl.
*G03G 15/16* (2006.01)

(52) U.S. Cl. ..... 399/66
(58) Field of Classification Search ..... 399/66, 399/310, 313, 314
See application file for complete search history.

(56) References Cited

U.S. PATENT DOCUMENTS 5,953,572 A * 9/1999 Takeuchi et al. ..... 399/66 X
6,904,245 B1 * 6/2005 Mochizuki et al. ..... 399/49

FOREIGN PATENT DOCUMENTS

| | | |
|---|---|---|
| JP | 10-026865 | 1/1998 |
| JP | 11-038799 | 2/1999 |
| JP | 11-352809 | 12/1999 |
| JP | 2000-147961 | 5/2000 |

* cited by examiner

*Primary Examiner*—Sandra L. Brase
(74) *Attorney, Agent, or Firm*—Stanzione & Kim, LLP

(57) ABSTRACT

A method of measuring a resistance of a transfer roller. The method includes driving a transfer belt supported by plural rollers and disposed in a transfer unit, which transfers an image from a photoconductive medium onto a recording medium, and calculating the resistance of the transfer belt while rotating the transfer belt at least one revolution. Accordingly, a testing voltage is prevented from continually being applied to an identical area of the transfer belt, thus preventing deformation and abrasions of the transfer belt due to stress. Also, an accurate average resistance to apply a compensated voltage can be measured according to an environment, thus facilitating the supply of a uniform amount of an electric current to the transfer roller and the formation of a high-resolution image.

13 Claims, 3 Drawing Sheets

METHOD OF MEASURING RESISTANCE OF A TRANSFER ROLLER

CROSS-REFERENCE TO RELATED APPLICATIONS

This application claims the benefit of Korean Patent Application No. 2003-76277, filed Oct. 30, 2003 in the Korean Intellectual Property Office, the disclosure of which is incorporated herein by reference in its entirety.

BACKGROUND OF THE INVENTION

1. Field of the Invention

The present invention generally relates to a method of measuring a resistance of a transfer roller, and more specifically, to a method of measuring a resistance of an entire area of a transfer roller rotating at least one revolution, by applying a testing voltage to the transfer roller.

2. Description of the Related Art

Conventionally, an image forming apparatus, such as a printer and/or a copier, has a transfer unit to transfer an image, which was developed in a photoconductive unit including a photoconductive medium, on a transferring medium such as a paper. The transfer unit has a transfer belt rotating on an endless track.

Plural rollers support the transfer belt and include a drive roller to generate a driving force for the transfer belt. When the image formed on the transfer belt is to be transferred to the transferring medium, the transfer roller contacts a side of the transfer belt. Next, a high voltage is applied to the transfer roller so that the image on the transfer belt is transferred onto a recording medium, such as a paper.

Meanwhile, when the high voltage is applied to the transfer roller, the transfer belt is temporarily rotating prior to the drive of the transfer unit to set an appropriate high voltage. Next, by applying a testing voltage to the transfer roller contacting the driving transfer belt, an average resistance is measured.

However, if the high voltage as the testing voltage is continually applied to a specific area of the transfer belt, the transfer belt develops an electrical fatigue, and due to this electrical fatigue, the transfer belt becomes stressed. As a result, stripes are formed on the transfer belt.

The stripes formed on the transfer belt may result in a difference of optical density of the image transferred on the recording medium, thus contaminating the transferred image. Thus, it is hard to form a high-resolution image.

SUMMARY OF THE INVENTION

Accordingly, it is an aspect of the present invention is to provide a method of measuring a resistance on an entire area of a transfer roller during at least one revolution thereof, thus preventing an electrical fatigue and eliminating differences of optical density.

Additional aspects and advantages of the invention will be set forth in part in the description which follows and, in part, will be obvious from the description, or may be learned by practice of the invention.

The foregoing and/or other aspects of the present invention are achieved by providing a method of measuring a resistance on an entire area of a transfer roller, the method including driving a transfer belt supported by plural rollers and disposed in a transfer unit which transfers an image transferred from a photoconductive medium onto a recording medium, and calculating the resistance by rotating the transfer belt at least one revolution.

The operation of calculating the resistance includes the operations of applying a testing voltage to the transfer belt to measure the resistance, measuring an electric current corresponding to the testing voltage, counting the number of measurements of the electric current, and obtaining the resistance from the testing voltage and the measured electric current.

The operation of calculating the resistance may include the operations of comparing the number of measurements with a preset reference value, and calculating an average resistance if the number of measurements is equal to or greater than the reference value.

In an aspect of the invention, the reference value is obtained by dividing a time for the transfer belt to rotate at least one revolution by a period of the number of measurements counted.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE INVENTION

Figure 1:
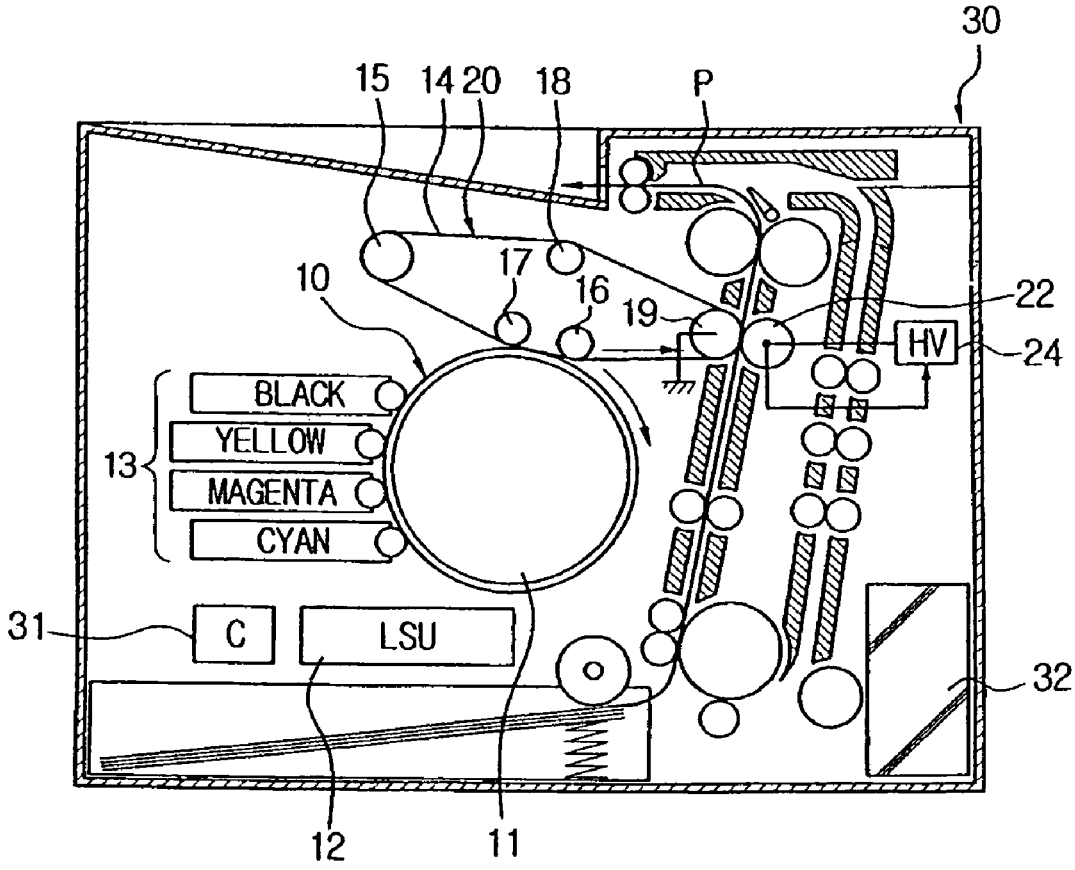
FIG. 1 is a cross-sectional view illustrating an image forming apparatus applying a method of measuring a resistance of a transfer roller according to an embodiment of the present invention.

Reference will now be made in detail to the present invention, examples of which are illustrated in the accompanying drawings, wherein like reference numerals refer to the like elements throughout. The invention is described below while referring to the figures.

FIG. 1 is a cross-sectional view illustrating an image forming apparatus applying a method of measuring a resistance of a transfer roller according to an embodiment of the present invention. A reference letter P indicates a paper delivery path.

As shown in FIG. 1, the image forming apparatus 30 includes a photoconductive unit 10 having a photoconductive medium (OPC drum) 11, a laser scanning unit 12, a developing unit 13, a transferring unit 20 having a transfer belt 14, plural rollers to rotate the transfer belt 14 on an endless track, and a transfer roller 22 to transfer an image. The plural rollers include a photoconductive transfer roller 16 to transfer the image onto the transfer belt 14, a drive roller 19 to supply a driving force to the transfer belt 14, a tension roller 18 to control tension of the transfer belt 14, a nip roller 17, and a backup roller 15 to idle according to the rotation of the drive roller 19.

A transfer roller 22 is in contact with a side of the transfer belt 14. The transfer roller 22 is also connected with a high voltage terminal 24 having an electric current detecting sensor (not shown) therein.

The transfer belt 14 is formed of a conductive material, and both ends of the drive roller 19 are earth-grounded, or another form of ground that will perform the desired features of the present invention. Also, the transfer belt 14 rotates on an endless track in contact with and between the drive roller 19 and the transfer roller 22.

If a predetermined voltage is applied to the high voltage terminal 24, the voltage flows via the transfer roller 22, the transfer belt 14, and drive roller 19 and descends to the ground through the both ends of the drive roller 19. At this time, the image formed on the transfer belt 14 is transferred onto a recording medium, such as a paper.

The image forming apparatus 30 has a driving force generator 32 to provide the driving force to the transfer belt 14 and a control unit 31 to control the driving force generator 32 and the high voltage terminal 24.

To form a desired image on a recording medium, the image forming apparatus 30 sequentially carries out procedures such as charging, laser scanning, developing, transferring, and fixing, in association with the other components.

Figure 2:
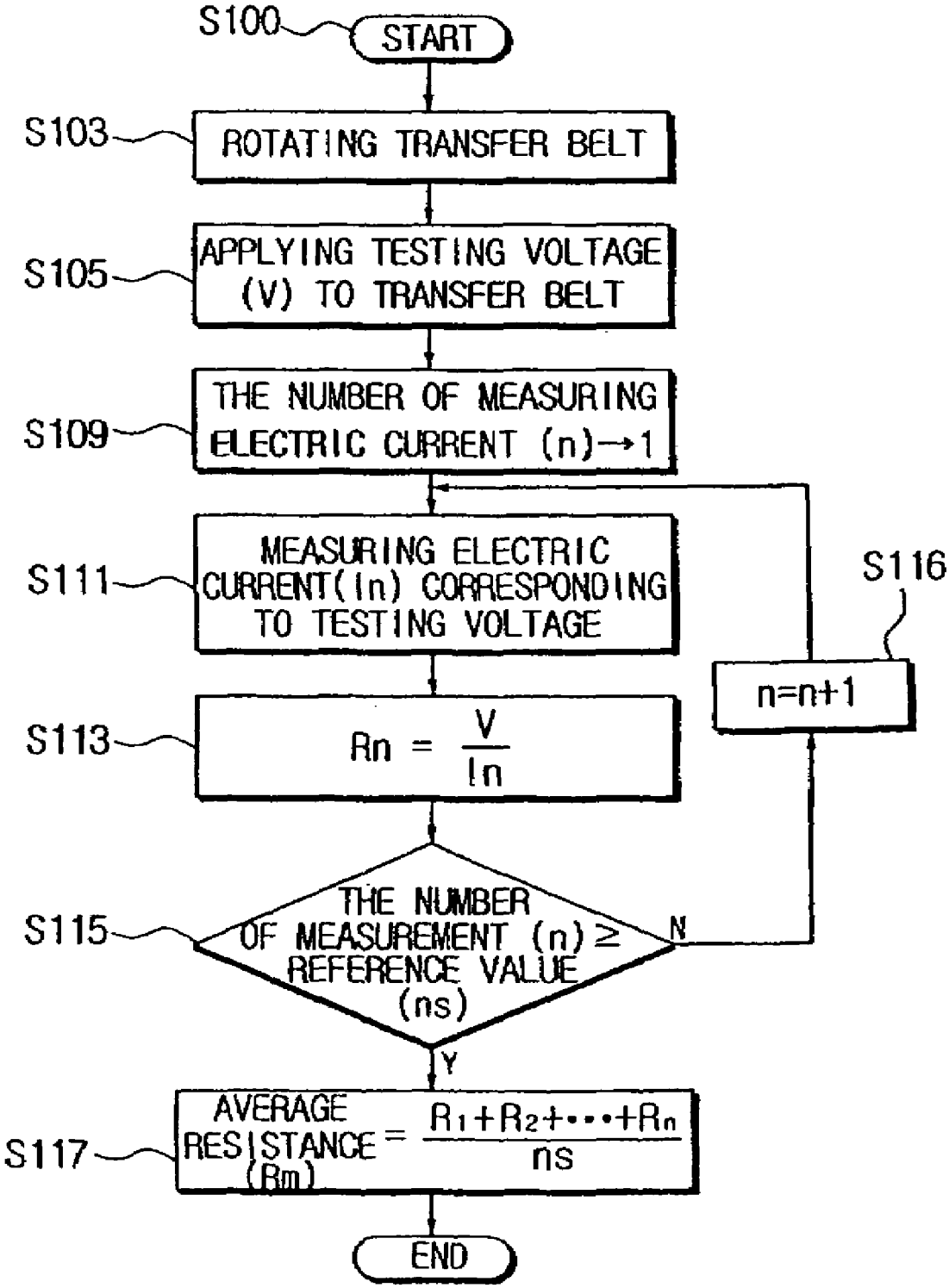
FIG. 2 is a flowchart illustrating the method of measuring the resistance of the transfer roller in FIG. 1.

A method of measuring the resistance of the transfer roller 22 is described according to an embodiment of the present invention below. FIG. 2 is a flowchart of the resistance measuring method.

Referring to FIG. 2, the resistance measuring method includes driving the transfer belt 14 and calculating the resistance of the transfer roller 22 from a voltage applied thereto.

The driving of the transfer belt 14 is described below.

The transfer belt 14 does not rotate before an image formed in the photoconductive unit 10 of the image forming apparatus 30 is transferred to the transferring unit 20, which is supported by the plural rollers, or before the image on the transfer belt 14 is transferred to the recording medium at operation S100.

The control unit 31 sends a control signal to the driving force generator 32 to drive the driving force generator 32. The driving force generator 32, which is connected to the drive roller 19 of the transferring unit 20, rotates the transfer belt 14 at operation S103.

The calculating of the resistance of the transfer roller 22 from the applied voltage by rotating the transfer belt 14 at least one revolution is described below. The transfer belt 14 may rotate 2 or 3 revolutions, however, the transfer belt 14 is rotated by one revolution according to this embodiment of the present invention.

The control unit 31 controls the high voltage terminal 24 connected to the transfer roller 22 to apply the testing voltage (V) to the transfer roller 22, which in turn rotates in close contact with the transfer belt 14, at operation S105.

The testing voltage (V) is a predetermined voltage to be regularly applied to the transfer roller 22 so as to measure the resistance of the transfer roller 22 before the image is transferred from the photoconductive unit 10 to the transfer belt 14, or before the image formed on the transfer belt 14 is transferred onto the recoding medium. The applied testing voltage (V) flows via the transfer belt 14 and the drive roller 19 and is grounded along the both ends of the drive roller 19.

The control unit 31 counts the number of times (n) that the testing voltage (V) is applied to the transfer roller 22, and stores the number of times (n) in a memory (not shown) of the control unit 31. The initial number of measurements (n) is set to n=1 at operation S109.

The control unit 31 measures an electric current ($I_n$) corresponding to the testing voltage (V). The current ($I_n$) is measured through a current measuring circuit (not shown) disposed in the high voltage terminal 24. The current measuring circuit (not shown) is connected to the transfer roller 22 and regularly measures the current ($I_n$) corresponding to the number of measurements (n) in which the testing voltage (V) is applied to the transfer roller 22, at operation S111.

Using the testing voltage (V) and the measured current ($I_n$), the resistance (Rn) of the transfer roller 22 is obtained by Formula 1 below according to the counted number of measurements (n), at operation S113.

$$R_n = \frac{V}{I_n} \quad \text{[Formula 1]}$$

Next, the number of measurements (n) is compared with a preset reference value (ns) at operation S115. The reference value (ns) is set by dividing a time spent for the transfer belt 14 to rotate one revolution by a period of the number of measurements (n).

Alternatively, the comparison of operation S115 may be performed between an elapsed time (t) after the rotation of the transfer belt 14 and a preset time (ts) required for one revolution of the transfer belt 14.

To determine whether the transfer belt 14 rotates one revolution, the comparison can be alternatively performed between the preset time (ts) and the elapsed time (t) or the number of measurements (n) and the reference value (ns).

According to the comparison, if the number of measurements (n) is less than the reference value (ns), the number of measurements (n) changes from 'n' to 'n+1' at operation S116 and the measuring of the current at operation S111 resumes. If the number of measurements (n) is equal to or greater than the reference value (ns), an average resistance ($R_m$) is calculated at operation S117 by Formula 2.

$$R_m = \frac{R_1 + R_2 + R_3 + \ldots + R_n}{ns} \quad \text{[Formula 2]}$$

Depending on the obtained average resistance ($R_m$), a compensated resistance (VS) can be obtained with respect to the average resistance ($R_m$) so as to supply a uniform amount of electric charge (Q) to the transfer belt 14.

Figure 3:
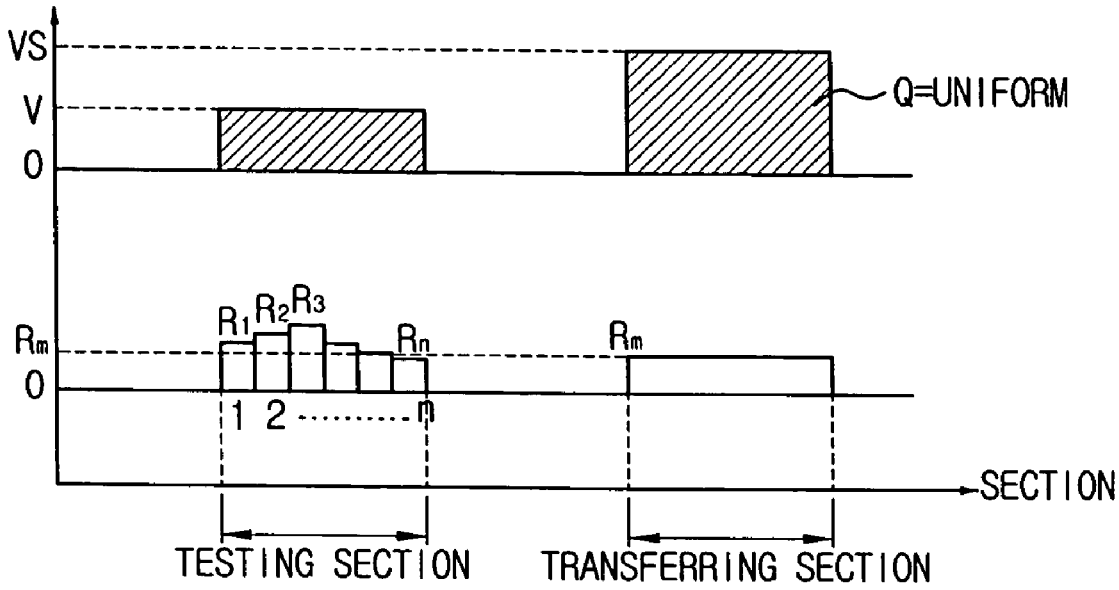
FIG. 3 is a graph illustrating the measured voltage and resistance according to the embodiment of FIG. 1.

FIG. 3 is a graph showing the voltage and resistance in FIG. 2. Referring to FIG. 3, the testing section represents a procedure to obtain the average resistance ($R_m$) of the transfer roller 22, and the transferring section represents a procedure to transfer the image from the photoconductive unit 10 to the transfer belt 14 or from the transfer belt 14 to the recording medium using the obtained average resistance ($R_m$).

The image transferred from the transfer belt 14 is in close relation with the amount of the electric charge (Q) flowing between the transfer belt 14 and the transfer roller 22. Accordingly, the maintenance of the uniform amount of the electric charge (Q) greatly affects the image quality.

The amount of the electric charge (Q) is in a functional relation with a voltage applied to the transfer roller 22. The voltage has to be variably applied to the transfer roller 22 according to the average resistance ($R_m$) of the transfer roller 22. In addition, since the average resistance ($R_m$) of the transfer roller 22 varies according to a surrounding environment and an abrasion degree of the transfer roller 22, the average resistance ($R_m$) of the transfer roller 22 has to be measured while the transfer belt 14 rotates by one revolution.

Hence, by measuring the average resistance ($R_m$) of the transfer roller 22, the compensated voltage (VS) can be correspondingly applied so that a uniform amount of the electric charge (Q) is applied to perform image formation.

When the transfer belt 14 rotates one revolution and the average resistance ($R_m$) of the transfer roller 22 is correspondingly obtained, the testing voltage (V) applied to the transfer roller 22 is prevented from continually being applied to an identical area of the transfer belt 14.

In the conventional method, the testing voltage (V) is applied to the transfer belt 14 when the transfer belt 14 rotates less than one revolution or the transfer roller 22 rotates only one revolution. As a result, the testing voltage (V) is applied to a specific area of the transfer belt 14 repeatedly and continually so that electrical fatigue is accumulated on the transfer belt 14 and stripes are formed thereon.

According to the embodiment of the present invention, a method of measuring a resistance of the transfer roller 22 can prevent the testing voltage (V) from continually being applied to a specific area of the transfer belt 14, thus preventing the transfer belt 14 from deforming due to stress.

Also, abrasions of the transfer belt 14 due to stress can be prevented.

The average resistance ($R_m$) of the transfer roller 22 can be accurately measured according to changes of a surrounding environment for the application of the compensated voltage (VS), so as to facilitate the supply of a uniform amount of electric charge. When the compensated voltage (VS) is applied, electric potential on the transfer belt 14 is equalized, and thus a desired high-quality image can be obtained.

Although a few embodiments of the present invention have been shown and described, the present invention is not limited to the disclosed embodiments. Rather, it would be appreciated by those skilled in the art that changes and modifications may be made in this embodiment without departing from the principles and spirit of the invention, the scope of which is defined by the claims and their equivalents.

What is claimed is:

1. A method of measuring a resistance of a transfer roller, comprising:

driving a transfer belt supported by plural rollers and disposed in a transfer unit which transfers an image from a photoconductive medium onto a recording medium; and calculating a resistance of the transfer roller while rotating the transfer belt at least one revolution.

2. The method of claim 1, wherein the calculating of the resistance comprises:

applying a testing voltage to the transfer belt;

regularly measuring an electric current from the transfer roller corresponding to the testing voltage;

counting the number of times the electric current is measured; and obtaining the resistance from the testing voltage and the measured electric current.

3. The method of claim 2, wherein the calculating of the resistance comprises:

comparing the number of measurements with a preset reference value; and calculating an average resistance if the number of measurement is equal to or greater than the reference value.

4. The method of claim 3, wherein the reference value is obtained by dividing a time for the transfer belt to rotate at least one revolution by a period of the number of measurements.

5. A method of applying a voltage to a transfer roller of an image transfer unit including a transfer roller and a transfer belt, comprising:

variably applying a voltage to the transfer roller according to an average resistance of the transfer roller during one rotation of the transfer belt.

6. The method of claim 5, wherein the operation of variably applying a voltage comprises:

counting a number of times a test voltage is applied to the transfer roller during one rotation of the transfer belt;

measuring currents of the transfer roller a number of times corresponding to the number of times at which the test voltage is applied to the transfer roller;

determining an average resistance of the transfer roller by calculating a resistance from the currents measured and the test voltage value for each time the test voltage is applied to the transfer roller, adding each resistance together, and dividing the result by the number of times the test voltage has been applied to the transfer roller during one rotation of the transfer belt; and controlling the voltage applied to the transfer roller according to the determined average resistance.

7. A method of applying a voltage to a transfer roller of an image transfer unit including a transfer roller and a transfer belt, comprising:

variably applying a voltage to the transfer roller according to an average resistance of the transfer roller during a number of rotations (n) of the transfer belt.

8. The method of claim 7, wherein the operation of variably applying a voltage comprises:

counting a number of times a test voltage is applied to the transfer roller during n rotations of the transfer belt;

measuring currents of the transfer roller a number of times corresponding to the number of times at which the test voltage is applied to the transfer roller;

determining an average resistance of the transfer roller by calculating a resistance from the currents measured and the test voltage value for each time the test voltage is applied to the transfer roller, adding each resistance together, and dividing the result by the number of times the test voltage has been applied to the transfer roller during n rotations of the transfer belt; and controlling the voltage applied to the transfer roller according to the determined average resistance.

9. A method of measuring a resistance of a transfer roller, the method comprising:

applying test voltages to different areas of a transfer belt through the transfer roller; and calculating a resistance of the transfer roller according to the test voltage and a current corresponding to the applied voltage.

10. The method of claim 9, further comprising:

rotating the transfer belt so that the test voltages are applied to different areas of the transfer belt.

11. The method of claim 9, wherein the applying of the test voltage comprises:

applying two test voltages to the transfer roller electrically connected to the transfer belt.

12. The method of claim 9, wherein the applying of the test voltage comprises:

choosing specific areas of the transfer belt in which test voltages are not to be applied through the transfer roller.

13. The method of claim 9, wherein the calculating of the resistance comprises:

obtaining the current in association with the different areas of the transfer belt.

* * * * *